US010398265B2

(12) United States Patent
Larsson et al.

(10) Patent No.: US 10,398,265 B2
(45) Date of Patent: Sep. 3, 2019

(54) DISPENSER FOR A STACK OF WEB MATERIAL

(71) Applicant: SCA Hygiene Products AB, Göteborg (SE)

(72) Inventors: Björn Larsson, Göteborg (SE); Hans Wallenius, Göteborg (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 0 days.

(21) Appl. No.: 15/549,291

(22) PCT Filed: Feb. 23, 2015

(86) PCT No.: PCT/SE2015/050205
§ 371 (c)(1),
(2) Date: Aug. 7, 2017

(87) PCT Pub. No.: WO2016/137364
PCT Pub. Date: Sep. 1, 2016

(65) Prior Publication Data

US 2018/0035850 A1 Feb. 8, 2018

(51) Int. Cl.
*A47K 10/42* (2006.01)

(52) U.S. Cl.
CPC ..... *A47K 10/424* (2013.01); *A47K 2010/428* (2013.01)

(58) Field of Classification Search
USPC ..... 221/45, 46, 48, 62, 63, 197, 287; 312/60, 50
See application file for complete search history.

(56) References Cited

U.S. PATENT DOCUMENTS 1,706,220 A 3/1929 Fairchild
1,827,904 A 10/1931 Parsons
(Continued)

FOREIGN PATENT DOCUMENTS

EP 0372781 A1 6/1990
WO WO 2011/062532 A1 5/2011
WO WO 2014/200394 A1 12/2014

OTHER PUBLICATIONS

Office Action dated Mar. 29, 2018, by the Australian Patent Office in corresponding Australian Patent Application No. 2015384223. (9 pages).

(Continued)

*Primary Examiner* — Gene O Crawford
*Assistant Examiner* — Ayodeji T Ojofeitimi
(74) *Attorney, Agent, or Firm* — Buchanan Ingersoll & Rooney PC

(57) ABSTRACT

A dispenser for dispensing sheets of web material is provided. The dispenser includes a dispenser housing and storage compartment for receiving a stack of sheets of web material. The housing has a front side, a rear side, upper and lower end portions, and two vertical sides connecting the front and rear sides, the lower end portion forming a dispensing end portion of the dispenser. The storage compartment includes a support arrangement for supporting the stack of sheets of web material at the dispensing end portion of the dispenser. The support arrangement a dispensing opening is arranged in a portion between the front, rear and side portions and an abutment surface to which the stack of sheets of web material can abut.

17 Claims, 5 Drawing Sheets

(56) References Cited

U.S. PATENT DOCUMENTS

| | | | | |
|---|---|---|---|---|
| 2,150,817 | A | 3/1939 | Boex | |
| 2,484,797 | A * | 10/1949 | Agamaite, Jr. ..... | A47K 10/424 221/46 |
| 2,830,728 | A | 4/1958 | Krueger et al. | |
| 3,028,047 | A | 4/1962 | Tuft | |
| 3,269,592 | A | 8/1966 | Slye et al. | |
| 3,341,067 | A | 9/1967 | Bastian | |
| 5,950,863 | A | 9/1999 | Schutz et al. | |
| 5,957,324 | A | 9/1999 | Gettelman et al. | |
| 7,845,515 | B2 * | 12/2010 | Moody ..... | A47K 10/424 221/36 |

OTHER PUBLICATIONS

International Search Report (PCT/ISA/210) dated Nov. 20, 2015, by the European Patent Office as the International Searching Authority for International Application No. PCT/SE2015/050205.

Written Opinion (PCT/ISA/237) dated Nov. 20, 2015, by the European Patent Office as the International Searching Authority for International Application No. PCT/SE2015/050205.

Extended European Search Report issued in corresponding European Patent Application No. 15883509.0, dated Oct. 18, 2018 (10 pages).

* cited by examiner

DISPENSER FOR A STACK OF WEB MATERIAL

TECHNICAL FIELD

The present invention relates to a dispenser, which comprises a support arrangement for supporting a stack of sheets of web material.

BACKGROUND

Various kinds of dispensers for dispensing sheets of material such as paper towels or the like from folded and stacked sheets of web material are well known in the art. One basic kind of dispenser comprises a housing provided with a dispensing opening at a lower end of the dispenser. A stack of paper towels may be placed in a storage compartment arranged within the housing such that the stack is oriented vertically therein. A paper towel at the bottom of the stack can be accessed via the dispensing opening and manually be pulled out through the dispensing opening. The stack of paper towels may be stored in the dispenser in various fold patterns, such as single fold, C-fold and interfold pattern. An interfolded stack of paper towels allows the user to pull out one paper towel at a time, while as one paper towel is pulled out a piece of the next paper towel is made to partly protrude from the opening such as to become ready for being dispensed and easy to grasp by the user.

The dispensers of the mentioned types should provide a reliable dispensing and storage of paper towels or the like, while being easy to handle, e.g. when gripping and pulling out a paper towel by a hand of a user from the dispenser.

There is still room for improvement with respect to dispensers of the mentioned type so as to provide reliable dispensing and storage of paper towels or the like.

SUMMARY

In view of the dispensers of the above-mentioned types, it is an object to provide an improved dispenser that is reliable and easy to use.

This object is wholly or partially achieved by dispensers according to the appended claims. Embodiments are set forth in the appended dependent claims, in the following description and in the drawings.

Thus, there is provided a dispenser for dispensing sheets of web material. The dispenser extends in a height direction (H), a width direction (W) and a depth direction (D). The dispenser comprises a dispenser housing and storage compartment for receiving a stack of sheets of web material. The housing has a front side, a rear side, upper and lower end portions, and two vertical sides connecting the front and rear sides. The lower end portion forms a dispensing end portion of the dispenser. The storage compartment comprises a support arrangement for supporting the stack of sheets of web material at the dispensing end portion of the dispenser. The support arrangement comprises a front portion, a rear portion and a pair of side portions connecting opposite ends of the front portion and the rear portion. A dispensing opening is arranged in the support arrangement in a portion between the front, rear and side portions. The dispensing opening of the support arrangement is defined by a surrounding edge formed by the front, rear and side portions. The edge comprises a leading edge portion and a rear edge portion, wherein the leading edge portion forms an upper guiding edge for the sheets of web material during dispensing thereof. The front portion of the support arrangement comprises a front abutment surface for supporting the stack of sheets of web material. The front abutment surface extends upwardly in a direction from the dispensing opening towards the front side of the dispenser. The dispenser further comprises a lower guiding edge for the sheets of web material during dispensing thereof. The lower guiding edge is arranged at a location downwards from the upper guiding edge towards the front side of the dispenser.

An HD plane extends in the height direction (H) and the depth direction (D) through the dispenser and the front side, the abutment surface, lower guiding edge, the leading edge portion, the dispensing opening, the rear edge portion and the rear side. The HD plane extends perpendicularly to the width direction (W).

The front abutment surface extends from a lowermost part of the abutment surface to an uppermost part of the abutment surface. A first straight line (A) extends in the HD plane through the lowermost part of the abutment surface and the uppermost part of the abutment surface. This first straight line (H) forms an angle $\alpha$ to a first horizontal line (h1) extending in the HD plane from a rear wall of the storage compartment. The angle $\alpha$ is from 30 degrees to 60 degrees. The angle $\alpha$ may be from 40 degrees to 50 degrees, preferably from 40 degrees to 45 degrees.

A third straight line (C) extends in said HD plane from a lowermost part of the upper guiding edge that defines a limitation for pulling a sheet of web material in contact with the upper guiding edge to lowermost part of the lower guiding edge that defines a limitation for pulling a straightened sheet of web material in contact with the lower guiding edge and the upper guiding edge, wherein the third straight line (C) forms an angle $\beta$ to the first horizontal line (h1).

A sum of the angles $\alpha$ and $\beta$ is from 45 degrees to 120 degrees. The sum of the angles $\alpha$ and $\beta$ may be from 60 degrees to 120 degrees, preferably from 80 degrees to 100 degrees.

The term "a stack of sheets of web material" is to be understood as a stack of material comprising folded sheets arranged in a stack, e.g. a stack of paper towels, napkins or hygienic towels. The sheets could also be articles that contain a nonwoven material as is known in the art. The sheets may be folded in any manner known in the art suitable for dispensing single sheets. For example the web material may be provided as two continuous perforated webs being interfolded to form a double web with the perforation lines of each web arranged in an offset relationship, or the web material may be provided as interfolded sheets as will be further exemplified herein and as known in the art.

As used herein, the terms "horizontal" and "vertical", "uppermost" and "lowermost", "downwards" and "upwards", "front" and "rear", and "upper" and "lower" or the like are to be understood as seen when the dispenser is arranged for use. As mentioned above, the dispenser extends in a height direction (H), width direction (W) and a depth direction (D). The height direction (H) extends in direction from a lower portion of the dispenser to an upper portion of the dispenser. The depth direction (D) extends perpendicularly to the height direction (H) from a rear portion to the front portion of the dispenser. The width direction (W) extends perpendicularly to the depth (D) and height (H) directions from one side portion to another side portion of the dispenser.

The term "edge" refers to a narrow part or portion where an object begins or ends, or forms a border to another portion such as the support arrangement edge bordering the dispensing opening of the support arrangement. The edge may adopt straight and/or rounded configurations.

As used herein, the term "guiding edge" or "guiding surface" refers to an edge or surface to which the sheet of web material such as a paper towel has or may have a contact with in a gliding manner of motion during a dispensing of the sheet of material by pulling out the sheet of web material from a storage compartment within the dispenser.

The term "abutment surface" refers to a surface of the support arrangement to which the stack of sheets of web material abuts or may abut when received and stored in the storage compartment, or to which abutments surface sheets of material abuts or may abut when dispensed from the storage compartment. For example, the front abutment surface is arranged at an inner side of the front portion of the support arrangement for supporting stack of paper towels as well as forming an inclined surface for easier dispensing of sheets of web material.

By providing the dispenser with the front abutment surface and upper and lower guiding edges and by amending the angles thereof, the dispensing action of the web material through the dispensing opening can be optimized by, for example, reducing the pull force required to pull the sheets of web material out from the dispenser. There is provided a lower angle limitation between two directions in which the sheets can travel during dispensing thereof so that the actual force required for pulling out a sheet of material from the dispenser becomes reduced as compared to pulling out a paper towel at more acute angle than the limitation allows for. Accordingly, the dispensing of the sheets from the dispenser becomes easy and safe leading to a minimum of tearing and tabbing of the paper towels during dispensing thereof, even when the sheets become wet, e.g. from the hands of a user.

The weight load of the stack of sheets of web material that is stored in the storage compartment also affects the dispensing of a lower paper towel of the stack of paper towels from the storage compartment. The arrangement of the abutment surface as specified above also leads to that the weight load of the stack of paper towels on the lowermost paper towels of the stack is mostly a load on lower paper towel portions close to the front side of the housing and on the front abutment surface of the support arrangement. The weight load will therefore pinch the lowermost paper towel portions close to the front side at the upper portion of the abutment surface together and against the upper portion of the front abutment surface. Lower most rear paper towel portions located closer to the rear wall will almost hang freely slightly above the lower rear portion with substantially no weight load acting thereon and with clearance spacing between each rear paper towel portions. In this way, the lowermost paper towels are safely kept in place in the storage compartment and a user can easily with a low pull force pull out the lowermost paper towel from the storage compartment, while the next paper towel will be guided towards and through the opening so as to partly protrude from the opening and be ready for dispensing.

The lowermost part and the uppermost part of the abutment surface are the parts or points in the HD plane that form ends of the abutment surface to which at least the bottom portion of the stack of sheets of web material arranged closest to the front side of the dispenser is intended to abut to. The uppermost part may be the uppermost possible junction point between the abutment surface and the frontmost portion of the support arrangement. The abutment surface may accordingly be a surface that extends along the HD plane in a substantially curved or straight manner. The abutment surface may contain different portions in the HD plane, which each one may be curved or straight. For example, the surface may extend in a faceted manner in the HD Plane.

The front abutment surface may have a main plane that extends upwardly in a direction from the dispensing opening towards the front side of the dispenser along the first straight line (A) between the lowermost and uppermost parts of the front abutment surface. Such a main plane of the front abutment surface forms the same angle $\alpha$ to the first horizontal line (h1) as the first straight line (A) extending in the HD plane from the lowermost part of the abutment surface to the uppermost part of the abutment surface.

The angle $\beta$ may from 5 degrees to 80 degrees, preferably from 15 to 70 degrees, more preferably from 30 to 60 degrees.

The dispensing opening of the support arrangement may be arranged in a portion that extends upwardly in an inclined direction from the rear side towards the front side of the dispenser. A fourth straight line (E) extends from the lowermost part of the rear edge portion to the lowermost part of the upper guiding edge. The fourth straight line (E) may form an angle $\varphi$ to the first horizontal line (h1) that is from 25 degrees to 60 degrees, preferably from 30 degrees to 60 degrees and more preferred from 40 degrees to 50 degrees.

The lowermost part of the rear edge portion may form a rear guiding edge for a limitation of pulling a sheet of web material in contact with the rear guiding edge, when the sheet of web material is pulled in an inclined direction downwards and towards the rear side of the dispenser.

The inclined dispensing opening provides an easy access to sheets of web material during the dispensing and causes that the dispensing action of the web material through the dispensing opening can be optimized by, for example, preventing any contact to sharp guiding edge portions and reducing the pull force required to pull the sheets of web material out from the dispenser.

The upper guiding edge has an edge surface forming an upper guiding surface for the sheets of web material during dispensing thereof. The upper guiding edge may have a thickness dimension (T1,T2) in the HD plane of at least 2.5 mm between the lowermost part of the upper guiding edge and an upper surface portion of upper guiding edge in the HD plane, which upper surface portion is arranged opposite to the lowermost part in the height direction (H) in the HD plane. The upper guiding surface borders the dispensing opening and extends in the HD plane between the lower most part and the upper surface portion of the upper guiding edge, thereby forming an extended smooth guiding surface for the sheet of web material to be in contact with during dispensing thereof. By "extended" here means that the distance the sheet of web material may travel and be in contact with the guiding surface in the HD plane between the lowermost part to the upper surface portion is extended as compared to normally formed edges in the art. The upper guiding surface may accordingly be a surface that extends along the HD plane in a substantially curved, rounded or straight manner. The upper guiding surface may contain different portions in the HD plane, which each one may be curved or straight. For example, the surface may partly or completely curve-formed or it may extend in a faceted manner along the HD plane.

The smooth surface of the upper guiding surface may preferably extend in the HD plane so that it does not form any acute angle change in its extension direction at any surface point along the surface that would form an angle of less than 90 degrees, preferably 80 degrees or less, or more preferably 70 degrees, between upper guiding surface portions connecting to the surface point or between an upper guiding surface portion and a surface portion of the support arrangement connecting to the surface point that overlaps with the lowermost part or the upper surface portion of the upper guiding edge. Normally, an upper guiding edge is formed by two tool elements in an injection moulding tool which forms a sharp edge which may lead to tearing of the paper towels during dispensing thereof, particularly when the paper is pulled forward in a horizontal direction towards a user standing in front of the dispenser. The upper guiding surface of the upper guiding edge as known in the art is usually only slightly rounded on an upper portion of the upper guiding edge and sharp on the lower portion thereof. The split line between the two tooling elements typically forms this sharp edge. By the provision of the extended smooth guiding surface, the split line can be moved such that any sharp edge is not formed at the upper guiding edge and the sheet can be dispensed over, for example, a substantially curved or rounded edge surface shape.

The extended smooth guiding surface is made possible by the provision of the thickness dimension (T1,T2) being at least 2.5 mm. The thickness dimension may be at least 4 mm. It may be 30 mm or less, preferably 15 mm or less.

The upper guiding surface may present one or more rounded surface portions in the HD plane so as to provide a smooth guiding surface that can be in contact with the sheets of web material. A portion of the upper guiding surface facing upwardly in an inclined direction towards the rear side of the dispenser may have a rounded surface portion in the HD plane. A portion of the upper guiding surface facing downwardly in an inclined direction towards the rear side of the dispenser may have a rounded surface portion in the HD plane. The radius (R1,R2) of each rounded surface portion may be at about 0.5 mm to 2 mm.

The extended upper guiding surface and the thickness dimension may be provided by the upper guiding edge being arranged with a rim, wherein such a rim extends in a downward direction at the dispensing opening, thereby forming a downwardly facing flange of the upper guiding edge that presents an upper guiding surface portion for the sheets of web material during dispensing thereof. The upper guiding has in such arrangement the dimension (T1) as mentioned above.

The shape of the rim may contain substantially curved, rounded or straight portions so as to provide that the upper guiding surface extends along the HD plane in a substantially curved, rounded or straight manner as mentioned above.

The rim provides a flange forming a "lip shape" of the upper guiding edge, for example a rounded "lip shape". The "lip shape" ensures a smooth dispensing, even when a sheet would be folded at a minimum folding angle 45 degrees around said guiding edge, the angle being the sum of the angles $\alpha$ and $\beta$. Normally, a guiding edge is formed by two tooling elements in an injection moulding tool which forms a sharp edge which often may lead to tearing of the paper towels during dispensing thereof, particularly when the paper is pulled forward in a horizontal direction towards a user standing in front of the dispenser. The guiding edge as known in the art is usually only slightly rounded on an upper side thereof and sharp on the lower side of the edge. The split line between the two tooling elements typically forms this sharp edge. By the provision of a rim, the split line can be moved further down to the center of the formed "lip" such that the sheet as described above travels over a rounded lip shape.

Connecting or attaching two or more components together so as to form the upper guiding edge may provide the extended smooth upper guiding surface and the thickness dimension (T2). For example, a lower component may be attached to an upper component. The upper component may be a base component forming the front portion of the support arrangement or the complete support arrangement. The lower component is in such a case attached to a downwardly facing surface of the upper arrangement so as to form the upper guiding edge of two or more components. For example, the base component may first be formed in an injection moulding tool as known in the art, wherein a upper guiding surface portion is slightly rounded on an upper portion of the upper guiding edge and sharp on a lower portion thereof due to the split line between two injection moulding tool elements that typically forms this sharp edge. The lower component may be formed in an injection molding tool so that an upper guiding surface portion thereof is slightly rounded on a lower portion thereof and sharp on an upper portion thereof due to the split line between two injection moulding tool elements. The lower component may then be attached to the upper component so that sharp edge portions connect to each other in an aligned way. In this way a perfectly smooth upper guiding surface may be provided.

The lower component may form a downwardly directed rim that resembles the rim described above. The lower component may also be attached to the upper component so as to partly or fully present the downwardly directed surface of the front portion of the support arrangement and, optionally, the rear portion of the support arrangement.

The dispenser housing may have a rear wall and a front wall. The front wall may be formed by a front door. The lower guiding edge may be formed by an edge of the lower end portion of the front wall or front door.

There is also provided a dispenser for dispensing sheets of web material. This dispenser extends in a height direction (H), a width direction (W) and a depth direction (D). The dispenser comprises a dispenser housing and storage compartment for receiving a stack of sheets of web material. The housing has a front side, a rear side, upper and lower end portions, and two vertical sides connecting the front and rear sides. The lower end portion forms a dispensing end portion of the dispenser. The storage compartment comprises a support arrangement for supporting the stack of sheets of web material at the dispensing end portion of the dispenser. The support arrangement comprises a front portion, a rear portion and a pair of side portions connecting opposite ends of the front portion and the rear portion. A dispensing opening is arranged in the support arrangement in a portion between the front, rear and side portions. The dispensing opening of the support arrangement is defined by a surrounding edge formed by the front, rear and side portions. The edge comprises a leading edge portion and a rear edge portion, wherein the leading edge portion forms an upper guiding edge for the sheets of web material during dispensing thereof. The front portion of the support arrangement comprises a front abutment surface for supporting the stack of sheets of web material.

An HD plane extends in the height direction (H) and the depth direction (D) through the dispenser and the front side, the abutment surface, lower guiding edge, the leading edge portion, the dispensing opening, the rear edge portion and the rear side. The HD plane extends perpendicularly to the width direction (W).

The front abutment surface extends from a lowermost part of the abutment surface to an uppermost part of the abutment surface in a direction from the dispensing opening towards the front side of the dispenser. A first straight line (A) extends in the HD plane through the lowermost part of the abutment surface and the uppermost part of the abutment surface. This first straight line forms an angle α to a first horizontal line (h1) extending in the HD plane from a rear wall of the storage compartment. The angle α is from 30 degrees to 60 degrees. The angle α may be from 40 degrees to 50 degrees, preferably from 40 degrees to 45 degrees.

The dispensing opening of the support arrangement is arranged in a portion that extends upwardly in an inclined direction from the rear side towards the front side of the dispenser. A fourth straight line (E) extends from the lowermost part of the rear edge portion to the lowermost part of the upper guiding edge. The fourth straight line (E) forms an angle φ to the first horizontal line (h1) that is from 25 degrees to 60 degrees, preferably from 30 degrees to 60 degrees and more preferred from 40 degrees to 50 degrees.

The upper guiding edge has an edge surface forming an upper guiding surface for the sheets of web material during dispensing thereof. The upper guiding edge has a thickness dimension (T1,T2) in the HD plane of at least 2.5 mm between the lowermost part of the upper guiding edge and an upper surface portion of upper guiding edge in the HD plane, which upper surface portion is arranged opposite to the lowermost part in the height direction (H) in the HD plane. The thickness dimension (T1,T2) may be at least 4 mm. It may be 30 mm or less, preferably 15 mm or less.

The front abutment surface may have a main plane that extends upwardly in a direction from the dispensing opening towards the front side of the dispenser along the first straight line (A) between the lowermost and uppermost parts of the front abutment surface. Such a main plane of the front abutment surface forms the same angle α to the first horizontal line (h1) as the first straight line (A) extending in the HD plane from the lowermost part of the abutment surface to the uppermost part of the abutment surface.

The term definitions and advantages described above are also part of the now described dispenser having similar features. The combination of the "extended" upper guiding edge that the thickness dimension (T1,T2) provides for with the inclined dispensing opening and the inclined front abutment surface reduces the pull force required to pull the sheets of web material out from the dispenser, even when a lower guiding edge is not arranged for limiting the angle at which the sheets of material are dispensed. This arrangement also minimizes any interruption during dispensing caused by, for example, tabbing or tearing of the sheets of web material.

The upper guiding surface may present one or more rounded surface portions in the HD plane so as to provide a smooth guiding surface that can be in contact with the sheets of web material. A portion of the upper guiding surface facing upwardly in an inclined direction towards the rear side of the dispenser may have a rounded surface portion in the HD plane. A portion of the upper guiding surface facing downwardly in an inclined direction towards the rear side of the dispenser may have a rounded surface portion in the HD plane. The radius (R1,R2) of each one of the rounded surface portions may be at about 0.5 mm to 2 mm.

As have been described above, the extended upper guiding surface may be provided by arranging a rim that forms part of at least the leading edge portion and extend in a downward direction at the dispensing opening, thereby forming a downwardly facing flange of the leading edge portion that presents an upper guiding surface portion for the sheets of web material during dispensing thereof. The provision of the rim provides the lip-shape as has been discussed above, which provides for the extended guiding surface.

As also been described above, the upper guiding edge with the extended upper guiding surface and the thickness dimension (T2) may be formed by connecting or attaching two or more components together.

The dispenser may further comprise a lower guiding edge for the sheets of web material during dispensing thereof, which the lower guiding edge is arranged at a location downwards from the upper guiding edge towards the front side of the dispenser. A third straight line (C) may extends in the HD plane from the lowermost part of the upper guiding edge that defines a limitation for pulling a sheet of web material in contact with the upper guiding edge to a lowermost part of the lower guiding edge that defines a limitation for pulling a straightened sheet of web material in contact with lower guiding edge and the upper guiding edge, wherein the third straight line (C) may form an angle β to the first horizontal line (h1). A sum of the angles α and β may be from 45 degrees to 120 degrees. The sum of the angles α and β may be from 60 degrees to 120 degrees, preferably from 80 degrees to 100 degrees.

The angle β may be from 5 to 80 degrees, preferably from 15 to 70 degrees, more preferably from 30 to 60 degrees.

The dispenser housing may have a rear wall and a front wall. The front wall may be formed by a front door. The lower guiding edge may be formed by an edge of the lower end portion of the front wall or front door.

In the dispensers described above, the rear edge portion may also be dimensioned as the upper guiding edge with similar thickness dimension as the thickness dimension (T1,T2) of the upper guiding edge, and with similar shapes and forms of a rear guiding surface as the upper guiding surface. It is appreciated that the rear guiding surface mainly faces in other direction than the upper guiding surface and the directions of surface portions as any rounded surface portions of the rear guiding surface may face towards the front side of the dispenser.

The disclosure will now be described in more detail with reference to embodiments and drawings.

BRIEF DESCRIPTION OF THE DRAWINGS

FIG. 4*a* also shows a stack of interfolded paper towels or the like stored in a storage compartment of the dispenser.

FIG. 5 illustrates some angles of the disclosure.

DETAILED DESCRIPTION

The present disclosure relates a dispenser for storing a stack of sheets of web material such as paper towels and for dispensing the sheets of web material.

In the following, the dispenser will be exemplified by a wall dispenser in a form of a cabinet, in which the stack of sheets of web material in a form of paper towels can be stored in a storage compartment. The paper towel stored in the storage compartment can be dispensed from the storage compartment at a lower end of the dispenser. However, this disclosure should not be construed as limited to the embodiments set forth herein. Other dispenser embodiments and forms of sheets of web material may also be considered within the scope of the appended claims. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1:
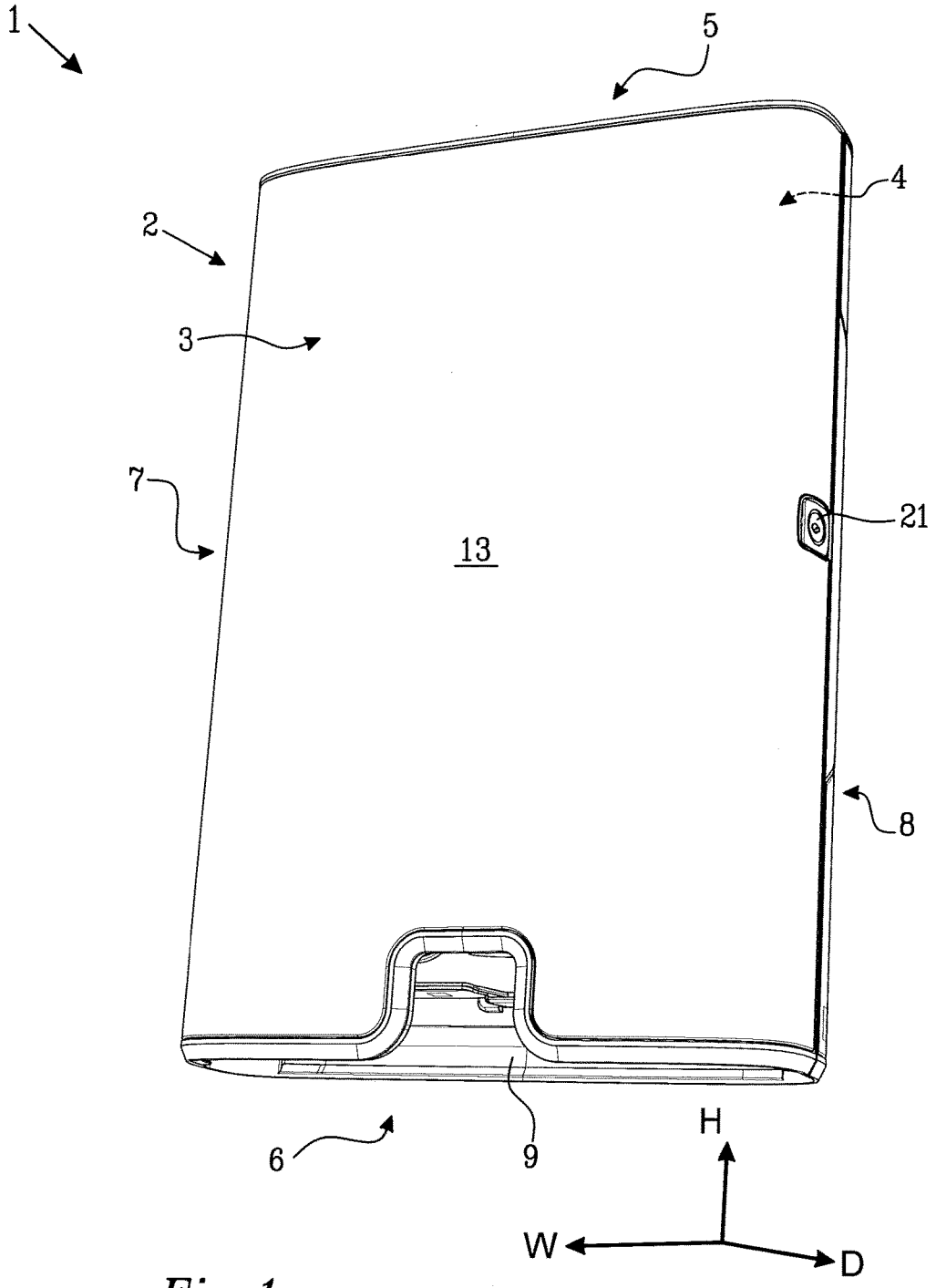
FIG. 1 is a front view of an embodiment of a dispenser.

FIG. 1 illustrates a wall dispenser 1 that extends a height direction L, a width direction W and a depth direction D. The dispenser 1 comprises a cabinet 2 forming a dispenser housing 2, each direction extending perpendicularly to each other. Furthermore, the cabinet 2 has a front side 3, rear side 4, upper and lower end portions 5, 6, and two vertical sides 7, 8 extending substantially in the height direction H and the depth direction D and connecting the front and rear sides 3, 4. The lower end portion 5 forms a dispensing end portion provided with an aperture 9 for dispensing sheets of web material stored within the dispenser 1.

Figure 2:
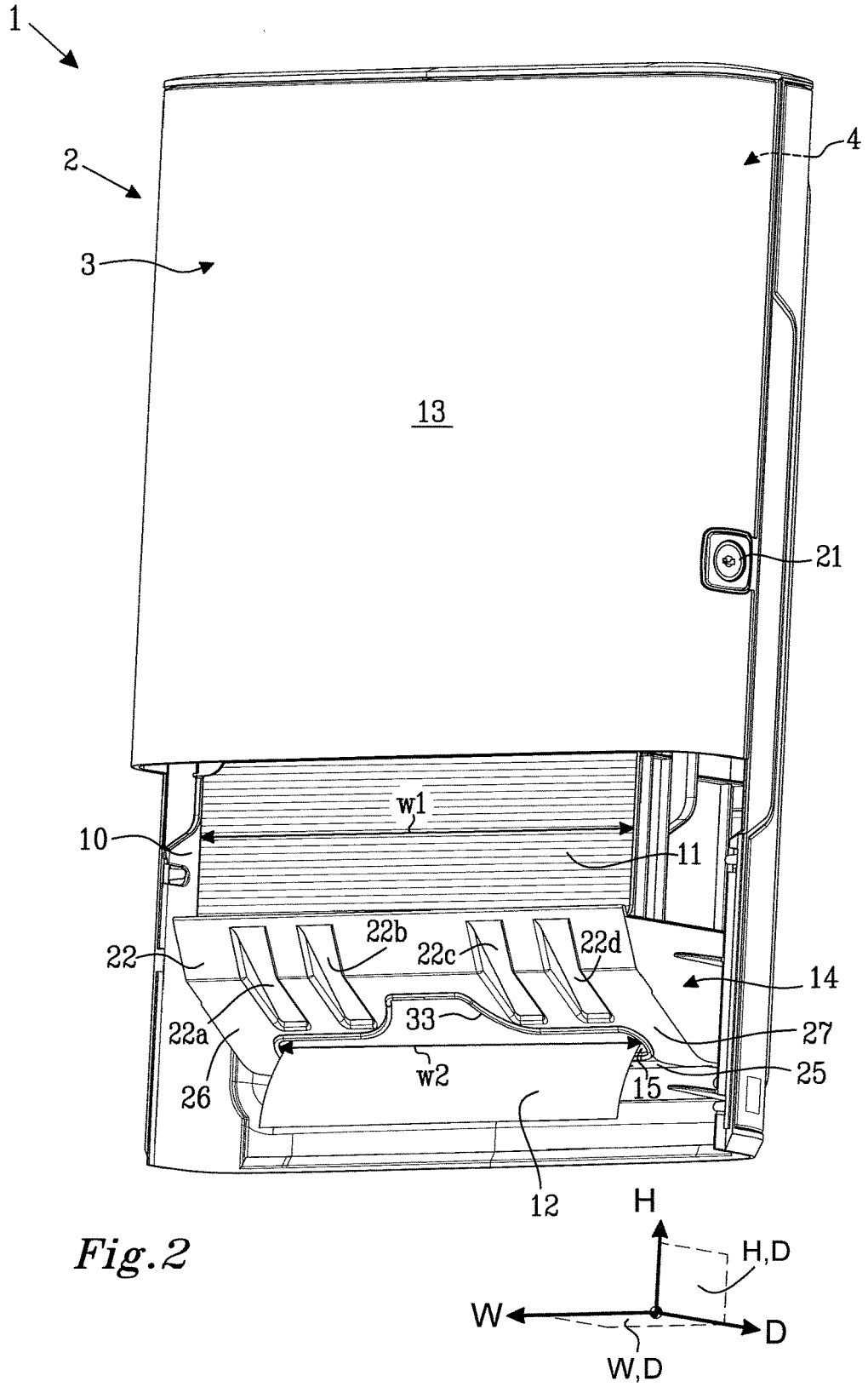
FIG. 2 is a perspective view of an embodiment of the dispenser as shown in FIG. 1, partly showing an interior space of the dispenser and a stack of paper towels or the like stored within the interior space.

FIG. 2 is a perspective view of the dispenser as shown in FIG. 1, partly showing an interior space of the dispenser and a stack of paper towels or the like stored within the interior space.

As illustrated in FIGS. 1 and 2, the cabinet 2 encloses a space, in which a storage compartment 10 for receiving the stack 11 of paper towels 12 is arranged. The cabinet 3 is provided with a front door 13 for accessing the storage compartment 10. The front door 13 forms the front side 3 of the cabinet 2. The storage compartment 10 comprises a support arrangement 14 for supporting the stack 11 of paper towels at a lower portion of the storage compartment 10. The support arrangement 14 further comprises an opening through which the paper towels 13 can be dispensed, thereby forming a dispensing opening 15 close to the dispensing end portion 5 of the cabinet 2.

Figure 3:
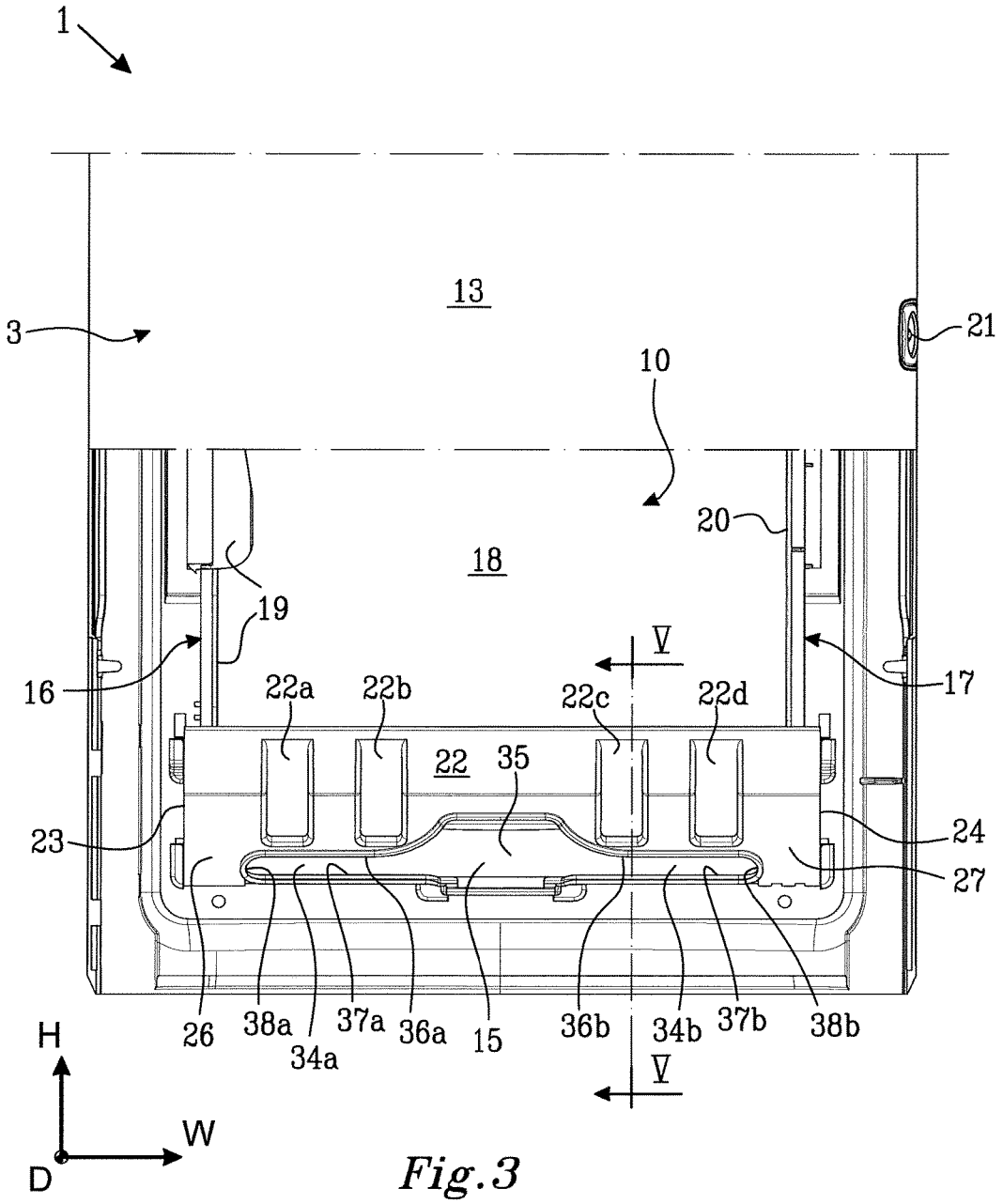
FIG. 3 is a front view of the dispenser as illustrated in FIG. 2, without showing any paper towels or the like stored within the dispenser.
Figure 4A:
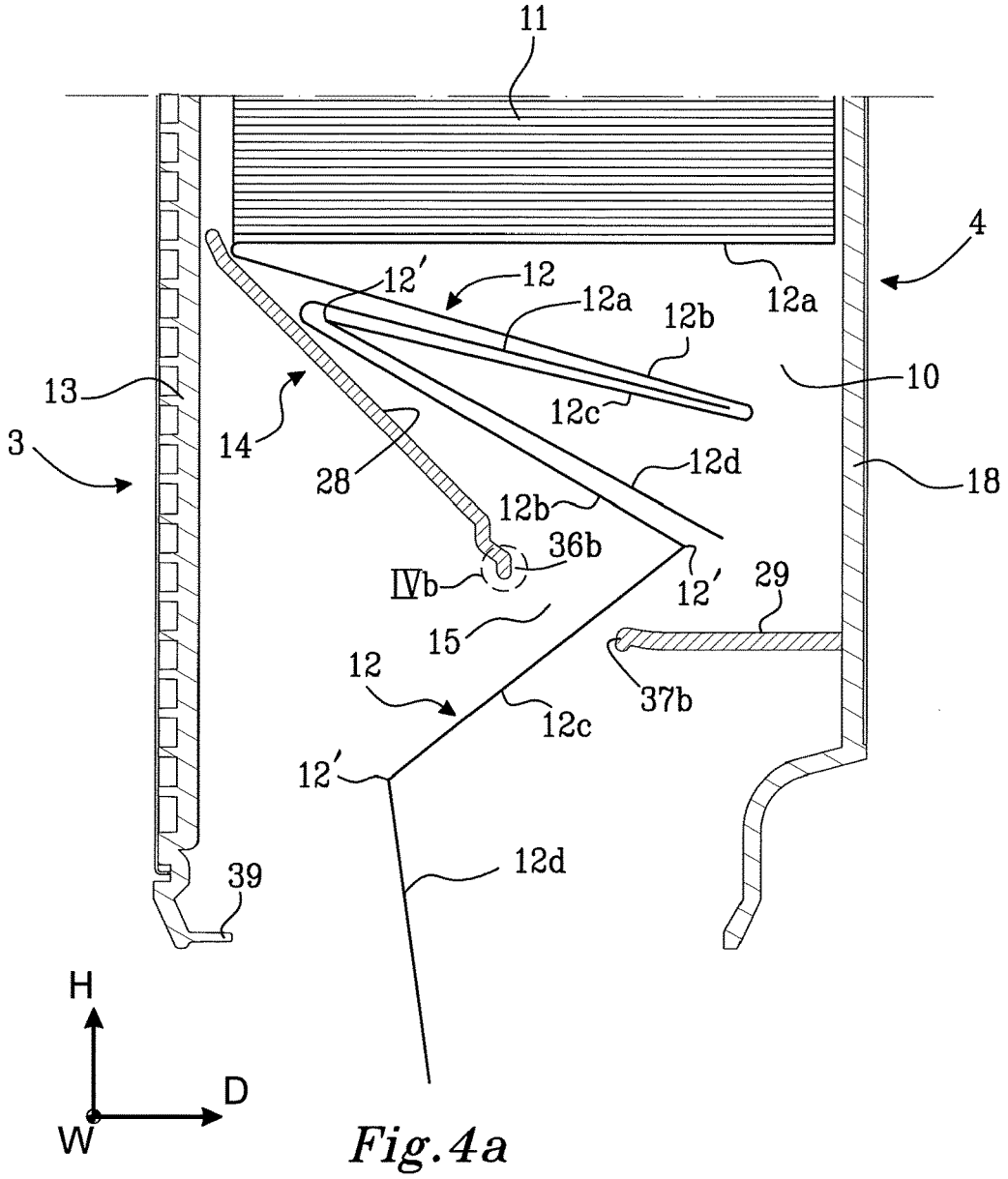
FIG. 4*a* is a cross-sectional side view of a lower end portion of the dispenser embodiment as shown in FIG. 3 as viewed from the line IV-IV. The cross-sectional view represents a plane through the dispenser.

FIG. 3 is a front view of the dispenser as illustrated in FIG. 2 as viewed towards the depth direction D. FIG. 4*a* is a cross-sectional side view of a lower end portion of the dispenser as shown in FIG. 3 as viewed from the line IV-IV. The view as shown in FIG. 4*a* represents HD plane extending in the height direction H and depth direction D of the dispenser. As illustrated in FIG. 3, the HD plane extends along the line IV-IV and in the depth direction D therefrom through the dispenser. The direction of such a plane is also indicated in FIG. 2.

As illustrated in FIGS. 2 to 4*a*, the support arrangement 14 further comprises a first side wall 16, a second side wall 17, and a rear wall 18, whereby the rear wall 18 at least extends between the first side wall 16 and the second side wall 17. The rear wall 18 may also form an integral part of a wall forming the rear side 4 of the cabinet 2. Together with the support arrangement 14, the first side wall 16, second side wall 17 and rear wall 18 form the main parts of the storage compartment 10 for receiving the stack 11 of paper towels.

The storage compartment 10 may also comprise front limiting parts opposite to the rear wall 18 so as to provide an additional support a stack of paper towels or the like, if so is required for the particular dispenser and sheets of web material in use. In many cases such front limiting parts are not required for adequately supporting the stack of paper towels.

As illustrated in FIGS. 2 and 3, the storage compartment 10 comprises a first bracket 19 extending from an edge of the first side wall 16 opposite to the rear wall 18 in a direction towards the second side wall 17 and a second bracket 20 extending from an edge of the second side wall 17 opposite to the rear wall 16 in a direction towards the first side wall 16. These brackets 19, 20 limit the storage compartment 10 in the dimension opposite the rear wall 18. The brackets 19, 20 support the stack 11 of web material, such that the stack 11 will not fall out from the storage compartment 10, when the door 13 of the cabinet 2 is open, e.g. during paper towel refilling of the storage compartment. Thus, the brackets 19, 20 form front limiting parts for supporting the stack 11 of paper towels. The brackets 19, 20 are further arranged such that a stack of paper towels can be loaded into the storage compartment 10 from the side opposite the rear wall 18.

The first and second brackets 19, 20 extend along different portions of the storage compartment for receiving the stack. Thereby, they are not necessarily arranged opposite each other, but may be arranged with an offset relative to each other. Thereby, a stack of paper towels or the like may be prevented from falling out of the storage compartment, while at the same time allowing stacks to be loaded into the storage compartment. Further, any interference of a dispenser 1 in the form of a cabinet 2 with a lock 21 of a cabinet front door 13 may be prevented.

As mentioned above, the provision of the brackets 19, 20 or any other front limiting parts is only an optional configuration of a storage compartment so as to provide an additional support a stack of paper towels or the like, if so is required. In many cases such brackets or the like are not required.

The storage compartment 10 may optionally comprise an overfill protection element arranged opposite to the support arrangement as is known in the art (not shown). This element limits the amount of stacks of web material that can be loaded in the storage compartment by limiting the length of the storage compartment 10. Thereby, an excessive loading of the dispenser 1 leading to problems such as bloating of sheets of web material from the dispensing opening and inefficient dispensing of web material can be prevented. In most cases, such a overfill protection element is not required.

As mentioned above, the support arrangement 14 provides a lower support for the stack 11 of sheets of web material, while a reliable dispensing of sheets of material such as paper towels 12 can occur by pulling out single paper towels from the dispensing opening 15 arranged in the support arrangement 14. As best illustrated in FIGS. 3 to 5, the support arrangement 10 comprises a front portion 22 in the form of a front ramp portion opposing the rear wall 18 of the storage compartment 10 and at least extending between side wall portions 23 and 24 arranged in the support arrangement. The side wall portions 23, 24 form parts of the first and second side walls 16, 17 of the storage compartment. The support arrangement 14 also comprises a rear portion 25 that comprises a lower portion that extends in a direction from the rear wall 18 towards a lower part of the front portion 22. The rear portion 23 also extends between the side wall portions 23, 24 of the support arrangement. The rear portion may also comprise a rear panel, which could form part of a lower wall portion of the rear wall 18 of the support arrangement (not shown). The dispensing opening 15 is arranged in a portion between the front, rear and side portions 22, 25, 26, 27. At least part of the dispensing opening 15 is arranged in a section that extends upwardly in an inclined direction towards the front side 3 of the dispenser 1.

The support arrangement 14 comprises abutment surfaces 28, 29 to which the stack of web material abuts or may abut when received in the storage compartment. Front abutment surfaces 28 are arranged at an inner side of the front portion 22 of the support arrangement 14 for supporting the stack 11 of paper towels and forming a gliding surface 28 for easier dispensing of the paper towels 12.

As mentioned above, both FIGS. 4*a* and 5 are views illustrating the HD plane taken along line IV-IV of FIG. 3 and extending in the depth direction through the dispenser, in particularly through parts such as the front side 3 and the rear side 4, as well as through the support arrangement 14, e.g. a front abutment surface 28 and the dispensing opening 15 thereof.

Each front abutment surface 28 has an uppermost part 30 and a lowermost part 31. The abutment surface forms a main plane that extends upwardly in an inclined direction towards the front side 3 of the dispenser 1 along a first straight line A between the lowermost part 31 and the uppermost part 30 of the abutment surface 28, wherein the main plane forms an angle $\alpha$ to a first horizontal line h1 extending in the HD plane from the rear wall 18. In the dispenser illustrated in FIGS. 4*a* and 5, the angle $\alpha$ is about 45 degrees. The angle $\alpha$ may be from 30 degrees to 60 degrees, preferably from about 40 degrees to about 50 degrees, more preferred from 40 degrees to 45 degrees. The angle $\alpha$ is chosen such that an efficient dispensing of the sheets of web material such as paper towels 12 is obtained. Thereby, the paper towels 12 can easily be pulled out one sheet at a time, while as one sheet 12 is pulled out a piece of the next sheet 12 is made to partly protrude from the opening 15 such as to be easy to grasp by the user. By amending the angle $\alpha$, the dispensing action of the web material through the dispensing opening 15 can be optimized. The illustrated abutment surface 28 has a main plane extending along the first straight line A. The abutment surface 28 may also adopt other shapes as described herein above, such as a curved shape, so that the first straight line A between the uppermost part 30 and the lowermost portion 31 the abutment surface 28 forms the angle $\alpha$ to the horizontal line h1.

As illustrated in FIGS. 2 and 3, the front abutment surfaces 28 are formed by a number of separate ridges and/or ramps 22*a-d*. Thereby the friction between the web material and the abutment surfaces 28 can be reduced, leading to easier dispensing of sheets of web material such as paper towels 12. The skilled person appreciates that a single front abutment surface 28 may replace the front abutment surfaces 28 formed by the four ramps 22*a-d* as illustrated in FIGS. 2-3.

A single front abutment surface 28 may be arranged along a larger section in the width direction W of the support arrangement, e.g. the single abutment surface may extend along a section in the width direction W that constitutes 70% or more of the extension of the support arrangement in the same direction. The single front abutment surface 28 should also have a main plane 30 that extends upwardly in an inclined direction towards the front side 3 of the dispenser so as to provide an angle $\alpha$ that has a similar value as discussed above. In the dispenser 1 of the present disclosure, such a single front abutment surface 28 would properly support the abutment against the stack of paper towels, while the dispensing thereof would be easy and safe leading to a minimum of tearing and tabbing of the paper towels during dispensing thereof, even when the paper towel becomes wet.

The length L1 of each front abutment surface 28 or the first straight line A from the lowermost part 31 to the uppermost part 30 of the front abutment surface 28 may vary depending on the dimension the sheets of web material such as paper towels. The length may be from 30 to 60% or 40 to 50% of the largest inner dimension the support arrangement has in the depth direction D in the HD plane between the front portion 22 and the rear wall 18, wherein the largest inner dimension largely corresponds to a dimension that a stack of sheets of web material has in the depth direction, when placed in the storage compartment.

Other abutment surfaces may also be arranged in the support arrangement 14. As illustrated in FIGS. 4*a* and 5, a rear abutment surface 29 is formed by the lower portion of the rear portion 25 of the support arrangement 14 just between the dispensing opening 15 and the rear wall 18. This abutment surface 29 is arranged well below the uppermost portion of the front abutment surface 28. In other words, the support arrangement illustrated in FIGS. 4*a* and 5 comprises the front abutment surface 28 having a main plane extending upwardly towards the front side and forming the angle $\alpha$ to the horizontal line h1 as described above. In the illustrated dispenser, the front abutment surface 28 extends in the HD plane further in a direction upwards along the dispenser, than the rear abutment surface 29 extends. Accordingly, where the first straight line A extending in the HD plane along the main plane of the front abutment surface 28 crosses the front portion 22 opposing the rear wall 18, the uppermost part 30 of the front abutment surface 28 is defined. A horizontal line h2 is defined extending in in the height direction H in the HD plane along and in contact with a lowermost abutment surface 29 portion of the rear side 25, and a vertical line V is defined extending through the rear wall 18 in the HD plane. The crossing of the horizontal line h1 and the vertical line V defines a junction point 32. A second straight line B extending in the HD plane through the uppermost part 30 and the junction point 32 forms an angle $\zeta$ to the horizontal line h2.

The angle $\alpha$ and the angle $\zeta$ are both preferably chosen such as to optimize the dispensing of the web material. In the illustrated dispenser, the angle $\zeta$ is about 31°. To this end, it is believed that the angle $\zeta$ may advantageously be at least 25°, preferably at least 30°. The sheets such as paper towels 12 can then be pulled out one sheet at a time, while as a sheet is pulled out by the user a piece of a next sheet is made to partly protrude from the opening 15, such as to be easy to grasp by the user.

As shown in FIGS. 4*a* and 5, the rear abutment surface 29 has a substantially horizontal main plane parallel to the horizontal line h2. It may optionally slightly extend upwardly or downwardly so that it forms an angle to the horizontal plane h2 in the HD plane of, for example, 20 degrees or lower (not shown).

The dispensing opening 15 formed for dispensing sheets of web material therethrough is arranged in an area between the front portion 22 with the front abutment surface (–s) and the rear portion 25, which may also be arranged with the rear abutment surface as described above. A portion of the dispensing opening 15 is arranged close to a lowermost part 31 of a front abutment surface 28 in a downward direction therefrom. The dispensing opening may be arranged within a distance of less than 10 mm or less than 5 mm from the lowermost portion of each front abutment surface. The front abutment surface (–s) 28 may extend in the same direction as the upwardly extending section, in which at least part of the dispensing opening 15 is arranged. The lowermost portion of the front abutment surface can therefore extend all the way to the opening 15 and form an edge (not shown).

The dispensing opening 15 of the support arrangement 14 is defined by a surrounding edge 33 formed by the front 22, rear 25 and side portions 26, 27 of the support arrangement 15. The opening 15 may adopt any shape that could support the storage of a stack 11 of paper towels and provide adequately dispensing of paper towels 12, such as a substantially rectangular shape, optionally with rounded ends, or slightly oval shape. As illustrated in FIG. 3, the dispensing opening is in the form of an elongated slot in the width direction W having two end portions 34*a-b* and an enlarged center portion 35 located intermediate the two end portions 34*a-b* forming a four-armed star shaped opening 15. The enlarged center portion 15 forms an area for accessing a paper towel to be dispensed from the dispenser, in particular in the case of accessing a paper towel 12 of a "new" bundle of paper towels, wherein no paper towel 12 protrudes from the opening 15.

The enlarged center portion 35 also provides an easy access to paper towels 12 that has been interrupted, torn or tabbed during the dispensing of the paper towels 12 from the storage compartment 10. The enlarged center portion 15 could be easily accessed via a recess arranged in a centered position at the lower end portion of the door 13, see FIG. 1.

As best seen in FIG. 2, the width w1 that the stack of paper towel has in the width direction W, when it is placed inside the storage compartment, is wider than the largest width w2 of the dispensing opening width in the width direction W. This provides for reduced risk of accidentally dispensing more than one paper towel 12, i.e. so called multi-dispensing or double-dispensing, in particular when the storage compartment 10 is almost empty of paper towels 12.

The end portions 34*a-b* of the opening 15 are formed to actuate on the dispensing movement of paper towels 12 through the opening 15. As illustrated in FIGS. 3 and 4*a*, each end portion 34*a-b* of the dispensing opening is defined by a leading edge portion 36*a-b* and a rear edge portion 37*a-b* and an end edge portion 38*a-b* connecting the leading edge portion 36*a-b* and the rear edge portion 37*a-b*. Each leading edge portion 36*a-b* forms an upper guiding edge for the sheets of web material during dispensing thereof. The dispenser 1 further contains a lower guiding edge 39 arranged at a location downwards from the upper guiding edge 36*a-b* towards the front side 3 of the dispenser 1.

As is illustrated in FIG. 4*a*, a lower end portion of the front door 13 of the cabinet 2 forms the lower guiding edge 39. The lower guiding edge 39 may also be formed by any dispenser part other than the front door 13 that suitably could form such a lower guiding edge 39 below the support arrangement close to the front side 3 of the dispenser 1 to provide a proper dispensing of paper towels 12.

A third straight line C extends in the HD plane from the lowermost part 40 of the upper guiding edge 36*b* that defines a limitation for pulling a sheet of web material in contact with the upper guiding edge 36*b* to a lowermost part 41 of the lower guiding edge 39 that defines a limitation for pulling a straightened sheet of web material in contact with lower guiding edge 39 and the upper guiding edge 36*b* (see FIGS. 4*a* and 5). The third straight line C forms an angle β to the first horizontal line h1.

In the illustrated dispenser, the angle β is about 53°. To this end, it is believed that the angle β may advantageously be from 5 degrees to 80 degrees, preferably from 15 degrees to 70 degrees, more preferably from 30 degrees to 60 degrees.

A sum of the angle α related to the extension of the front abutment surface as described above and the angle β may be from 45 to 120 degrees. The sum of the angles α and β may preferably be from 60 degrees to 120 degrees, preferably from 80 degrees to 100 degrees. In the illustrated dispenser, the angle is about 97 degrees.

By amending the angles α and/or β, the dispensing action of the web material through the opening portions can be optimized to reduce the pull force required to pull the sheets of web material out from the dispenser, in particular along the third straight line C. The pulling direction is thereby limited so as to reduce any force required.

As mentioned above, the dispensing opening is arranged in a portion that extends upwardly in inclined direction from the rear side towards the front side of the dispenser. As illustrated in FIG. 5, a fourth straight line E extends in the HD plane from a lowermost part 42 of the rear edge portion 37*b* to the lowermost part 40 of the upper guiding edge 36*b* that defines the limitation for pulling a sheet of web material in contact with the upper guiding edge 36*b*. The fourth straight line E forms an angle φ to the first horizontal line h1 that is from 25 to 60 degrees. The angle φ may be from 30 degrees to 60 degrees, more preferred from 40 degrees to 50 degrees. In the illustrated dispenser, the angle φ is about 32 degrees.

The spatial relations of the opening 15 and the edge portions 36*b*, 37*b* surrounding it in relation to the lower guiding edge 39 may be illustrated by a fifth straight line F extending through the lowermost part 41 of the lower guiding edge and the lowermost part 42 of the rear edge portion 37*b*, and which fifth straight line F forms an angle γ to the first horizontal line h1. In the dispenser as illustrated in FIG. 5, the angle γ is about 37 degrees. To this end, it is believed that the angle γ may advantageously be from 25 degrees to 60 degrees, more preferred from 30 degrees to 50 degrees.

Figure 4B:
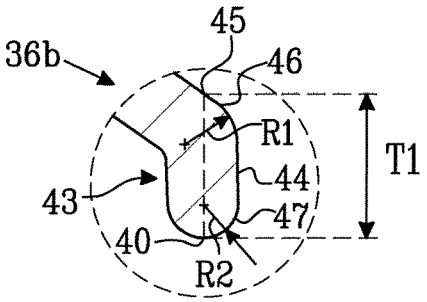
FIG. 4*b* shows an enlargement a detail of area IVb in FIG. 4*a*.
Figure 5:
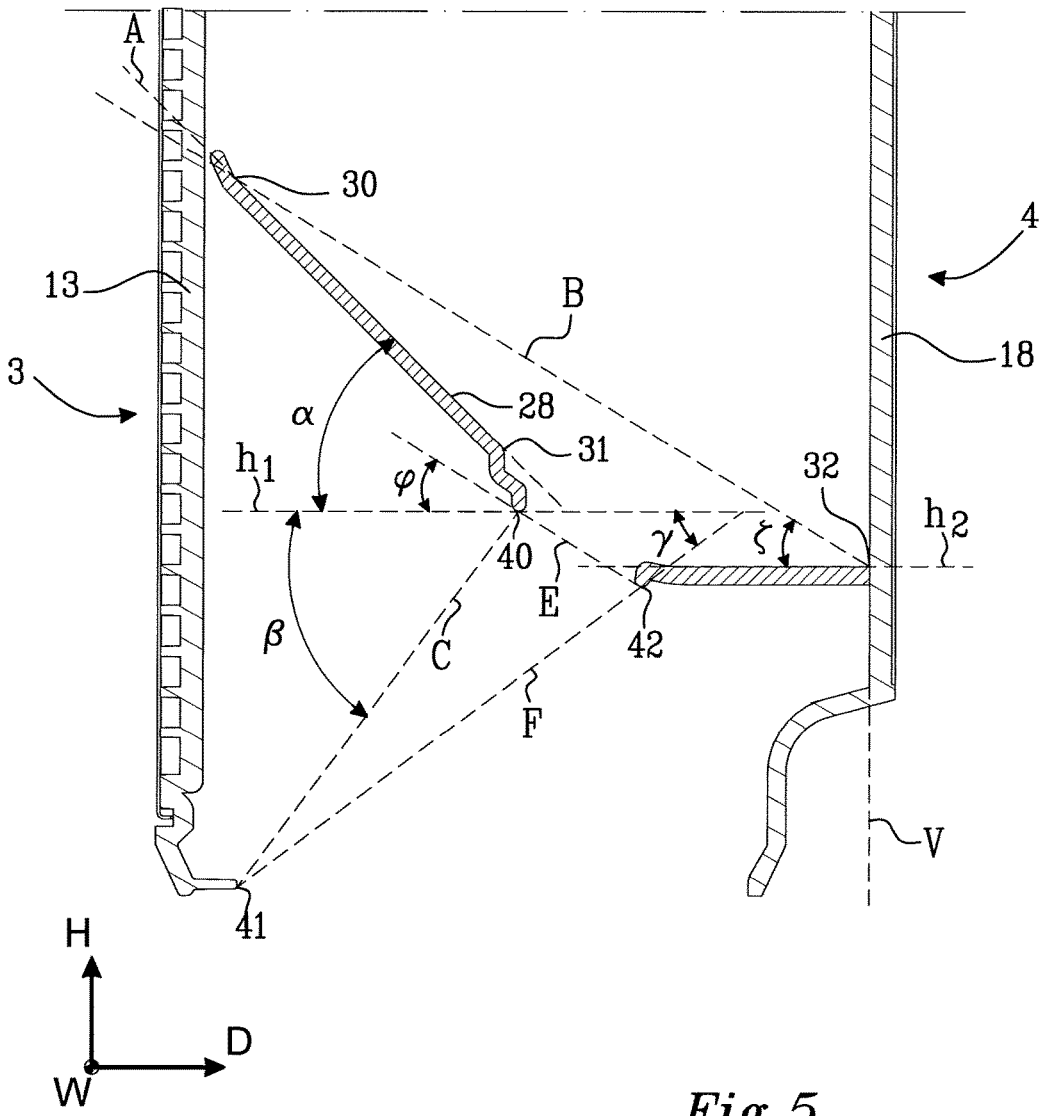
FIG. 5 is a cross-sectional side view corresponding to the view as shown in FIG. 4*a*, but without any paper towels or the like stored in the dispenser.

FIG. 4*b* illustrates an enlargement of an area IVb as depicted in FIG. 4*a* showing the upper guiding edge 36*b*. As illustrated in FIGS. 4*a* and 4*b*, a rim 43 forms part of at least the upper guiding edge 36*b* and extends in a downward direction from the support arrangement 14 and a downwardly facing surface thereof at the dispensing opening, thereby forming a downwardly facing flange 43 of the leading edge portion 36*a-b* that presents an extended guiding surface 44 for the sheets of web material during dispensing thereof. In the illustrated dispenser, the rim or a similar rim also forms part of the rear edge portion 37*a-b*.

The provision of the rim 43 provides the lip-shape as has been discussed above. It has shown that the provision of such a rim 43 in combination with the inclined dispensing opening 15 and the inclined front abutment surface 28 reduces the pull force required to pull the paper towels out from the dispenser 1, even in the case when a lower guiding edge 39 is not present for limiting the angle at which paper towels are dispensed (not shown). This arrangement also minimizes any interruption during dispensing caused by, for example, tabbing or tearing of the paper towels.

As best seen in FIG. 4*b*, the upper guiding edge 36*b* has a thickness dimension T1 in the HD plane between the lowermost the lowermost part 40 of the upper guiding edge 36*b*, i.e. of the rim 43, and an upper surface portion 45 of upper guiding edge in the HD plane, which upper surface portion 45 is arranged opposite to said lowermost part 40 in the height direction H in the HD plane. The thickness dimension may be at least 2.5 mm. The rim 43 may protrude downwards with a distance of at least 0.5 mm, preferably from 0.5 mm to 10 mm, from a downwardly directed surface connecting the rim to the support arrangement (dimension not illustrated).

At least the upper guiding edge 36*b* has an edge surface forming an upper guiding surface 44 for the sheets of web material during dispensing thereof. The upper guiding surface 44 may present one or more rounded surface portions. A portion of the upper guiding surface 44 facing upwardly in an inclined direction towards the rear wall 18 may have a rounded surface portion 46. A portion of the upper guiding surface portion facing downwardly in an inclined direction towards the rear wall 18 may have a rounded surface portion 47. The radius (R1;R2) of the rounded surface portions may be about 0.5 mm to 2 mm.

The arrangement of a rim 43 and rounded portions 46, 47 provides a smooth gliding surface 44 with hardly any sharp edges that the sheets of web material comes in contact with during dispensing thereof. This contact surface 44 between the leading edge portion 36*a-b* and the sheets of web material during dispensing thereof is also enlarged by provision of the rim 43 extending downwards from at least the leading edge portion 36*a-b*, thereby forming a flange or lip presenting a smooth guiding surface 44 for the sheets of web material during dispensing thereof.

Figure 4C:
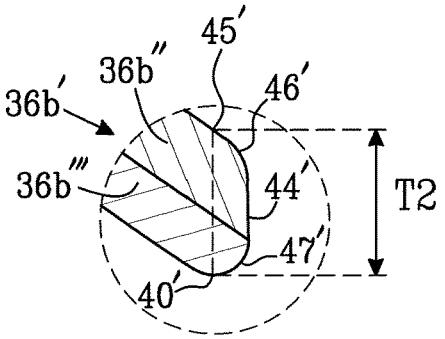
FIG. 4*c* shows a variant of the detail as shown in FIG. 4*b*.

FIG. 4*c* shows an enlargement of an upper guiding edge 36*b*' and an alternative way of forming the extended guiding surface 44' thereof. As illustrated in FIG. 4*b*, Connecting or attaching two components 36", 36'" together so as to form the upper guiding edge 36*b*' may provide the extended smooth upper guiding surface 44' and a thickness dimension T2 in the HD plane between the lowermost part 40' of the upper guiding edge 36*b*' and an upper surface portion 45' of upper guiding edge 36*b*', which thickness dimension has the same dimensions as T1.

As illustrated in FIG. 4*c*, a lower component 36*b*" is attached to an upper component 36*b*'". The upper component 36*b*'" is the base component forming the complete support arrangement 14. The lower component 36" is attached to a downwardly facing surface of the upper component so as to form the upper guiding edge 36*b*' of two components. For example, the upper component 36*b*'" may first be formed in an injection moulding tool as known in the art, wherein a upper guiding surface portion it forms is slightly rounded on an upper portion 46' of the upper guiding edge 36*b*' and sharp on a lower portion thereof. The lower component 36*b*" may be formed in an injection molding tool so that an lower guiding surface portion is slightly rounded on an lower portion 47' thereof and sharp on an upper portion thereof. The lower component 36*b*" may then be attached to the upper component 36*b*'" so that sharp edge portions connect to each other in an aligned way as seen in FIG. 4*c*. In this way a perfectly smooth upper guiding surface is provided. The upper guiding edge 36*b*' formed has the thickness dimension T2, a radius of rounded portions 46', 47' that correspond to the thickness dimension T1 and radius R1,R2 of the lip-shaped upper guiding edge 36*b* as shown in FIG. 4*b*.

The stack 11 of paper towels stored in the storage compartment of the dispenser could be formed of a plurality of single folded, c-folded or inter-folded paper towels. As illustrated in FIG. 4*a*, there is provided a plurality of paper towels 12 in a stack 11 that is stored in the storage compartment 10 of the dispenser. Each paper towel 12 is provided with three folds 12' and has four equal panels along the length of the paper towel 12. The paper towel has an upper panel 12*a*, two intermediate panels 12*b-c* and a lower panel 12*d*. The illustrated inter-folded paper towels 12 are interlinked in the stack by means of each of the paper towel 12 within the stack comprising at least one pair of panels being folded together in a sandwiched manner with a pair of adjacent panels of another of the paper towel within the stack 12. When the lowermost paper towel 12 is pulled out from the storage compartment 10 of the dispenser 1, substantially two panels of the next paper towel 12*c-d* are also pulled out to protrude from the opening 15 such as to become ready for being dispensed and easy to grasp by the user.

As is also illustrated in FIG. 4*a*, the weight load of the stack 11 also affects the dispensing of a lower paper towel 12 from the stack of paper towels. The arrangement of the dispenser disclosed herein leads to that the weight load of the stack of paper towels on the lowermost paper towels 12 therein is mostly a load on the paper towel portions close to the front side 3 of the cabinet 2 and the front abutment surface 28 of the support arrangement 14, which load will pinch the lowermost paper towel portions together at the upper portion of the abutment surface as well as against the upper portion of the front abutment surface. Rear paper towel portions located closer to the rear wall will almost hang freely slightly above the rear abutment surface 29 with substantially no weight load thereon and with clearance spacing between each rear paper towel portions. In this way, the lowermost paper towels are safely kept in place in the storage compartment and a user could easily pull out the lowermost paper towel from the storage compartment using low pull force, while the next paper towel will be guided towards and through the opening so as to partly protrude from the opening and be ready for dispensing.

As the skilled person will appreciate, it is intended that the detailed description be regarded as illustrative and that many embodiments and alternatives are possible within the scope of the present disclosure as defined by the appended claims. For example, the dispenser may adopt other shapes than the ones shown in the drawings. Furthermore, the dispenser has been exemplified with paper towels, while other sheets of web material such as tissues, e.g. facial tissues or toilet tissues, or the like may also form part of the disclosure.

EXAMPLES AND TEST METHOD

Aim and Samples

The aim of the test method was to determine a pull force being the maximum force as measured when pulling out a sheet of web material at different pulling directions from a dispenser as disclosed herein. The pull directions tested were straight downward, straightforward in the horizontal direction and at an angled direction from the lower dispensing opening 15 of the dispenser 1. An additional test was made for pulling the sample sheets at the angled direction, in which test an extra weight load of two kilograms was placed on top of the stack of sheets of web material. The angles and other details will be described further below.

The test also included scoring the number of torn and tabbed samples during the test.

Corresponding comparative dispenser was also tested with the same type of sheets of web material.

Apparatus, Samples and Settings

A Force Gauge meter available from Mecmesin was used (Force gauge meter: Mecmesin BFG 50 N).

The clamp used in the force measurement had the size of 10×120 mm.

The tested sheets of web material were: Tork Xpress® Extra Mjuk Multifold Handduk (Extra Soft Multifold Hand Towel) 2-ply article no 100297 available from SCA Hygiene Products AB.

The storage compartment of each dispenser was filled to the maximum level (top) with a height of the towel stack of about 350 mm.

A dispenser according to the disclosure was tested, wherein angles as defined herein were: $\alpha$=45 degrees, $\beta$=53 degrees, $\varphi$=32 degrees, $\gamma$=37 degrees, $\zeta$=31 degrees. This dispenser also had a downwardly formed rim at the upper guiding edges (36*a-b*) forming an extended rounded guiding surface. The T1 dimension was about 4 to 6 mm. The radius (R1; R2) of the rounded edge surfaces was about 1-2 mm.

A dispenser available from SCA Hygiene Products AB was used as a comparative dispenser. The dispenser was Tork Xpress® Dispenser Multifold Hand Towel White, article no. 552000. The angles of the comparative dispenser in line with the angle definitions herein were: $\alpha$=25 degrees, $\beta$=75 degrees, $\varphi$=14 degrees, $\gamma$=48 degrees, and $\zeta$=13 degrees. This dispenser had an upper guiding edge as typically has a lower sharp edge formed in the injection molding tool during forming the support arrangement of the dispenser. The formation of such a sharp edge has been discussed further above.

Test Procedure

For each dispenser, 10 pull tests were performed at pull direction. The maximum forces were recorded and any tabbing and/or tearing of the paper towel samples were also recorded as number of torn towels of the 10 towels pulled out from the tested dispenser.

The dispensers were mounted on a wall in its normal direction of use. The pull force was measured using the force gauge meter (Mecmesin BFG 50 N). The clamp of the force gauge meter was fitted to the gauge meter and the meter was set to register the maximum pull force during the dispensing of a towel. Each dispenser was filled to maximum level as mentioned above. The clamp was attached to the middle of the sheet about 1 cm inwards from the front tail of the towel with the widest clamp portion extending in the width direction W of the towel and relative each dispenser.

The tests were performed with the cabinet door of each dispenser open, if so required or considered convenient.

The force gauge meter was reset to zero before and between each force measurement.

In a first test and for each tested dispenser, a towel was pulled straight downward by moving the Gauge meter at a slow even speed in a downward direction. This was repeated 10 times in the same way, each time with a new towel being dispensed. The maximum pull force and as well as any tabbing or tearing were recorded for each towel pulled out from the dispenser.

In a second test, a similar pull test procedure was performed, with the exception that each towel was pulled out from the dispensing opening in a horizontal pull direction. Accordingly, the towel was pulled out by moving the Gauge meter at a 90-degree angle from the wall towards the test person at a slow even speed. The maximum force and any tabbing or tearing results were recorded.

In a third test, a similar pull test procedure as described above was performed, with the exception that each towel was pulled out from the dispensing opening in a inclined downward direction and out from the wall towards the test person at an angle to the wall of 30 degrees. Accordingly, the towel was pulled out by moving the Gauge meter in the mentioned direction at a slow even speed. The maximum force and any tabbing or tearing results were recorded.

In a fourth test, a similar pull test procedure as described for the third test was performed, with the exception of that an additional weight load of 2 kg was placed on the top of the stack.

Results

The results are reported as the average maximum force in N using two decimals of each test of pulling 10 samples. Furthermore, the number of samples that had undergone tearing and/or tabbing during the test is also given as a torn number, i.e. number of torn or tabbed samples of the 10 samples tested.

EXAMPLES

The results are set forth in Table 1 below.

TABLE 1

Pull force in N and torn number of samples

| | Dispenser of the disclosure | | Comparison dispenser | |
|---|---|---|---|---|
| Pull angle | Pull force (N) | Torn number (0—good; 10—bad) | Pull force (N) | Torn number (0—good; 10—bad) |
| First test; Vertical | 1.74 | 0 | 7.32 | 0 |
| Second test; Horizontal | 5.65 | 0 | 22.84 | 7 |
| Third test; Angle forward | 3.19 | 0 | 15.48 | 0 |
| Fourth test; Angle forward; Added 2 kg weight | 7.34 | 0 | 25.83 | 7 |

The results of a vertical pull test clearly indicate that the relatively steep slope of the front abutment surface indeed lower the pull force required for dispensing a paper towel.

It is also clear that horizontal pull test results show a beneficial effect of arranging the front abutment surface with a steep sloop. The results of the horizontal test are also influenced by having the dispensing opening of the support arrangement arranged in a inclined portion as described herein, as well as by the provision of a downwardly extending rim at the leading edge at the dispensing opening that provides a smooth extended guiding surface for the paper towel during dispensing thereof, even when the towels is dispensed in the horizontal direction.

The angle forward tests aimed at testing the influence of the inclined abutment surface together with the provision of a limited angled pull direction as the guiding edges of the present disclosure provide. Also here the extended upper guiding surface could be considered.

The results with added weight load of 2 kg shows that the pull force required to pull out a paper towel from the dispenser of the present disclosure is low even at extreme weight loads. This is clearly not the case form the comparative dispenser. This pull test for the comparative dispenser also resulted in torn samples, while no samples were torn for the dispenser of the present disclosure.

The invention claimed is:

1. A dispenser for dispensing sheets of web material, the dispenser extending in a height direction, a width direction and a depth direction, wherein the dispenser comprises a dispenser housing and storage compartment for receiving a stack of sheets of web material, the housing having a front side, a rear side, upper and lower end portions, and two vertical sides connecting the front and rear sides, the lower end portion forming a dispensing end portion of the dispenser, wherein the storage compartment comprises a support arrangement for supporting the stack of sheets of web material at the dispensing end portion of the dispenser, said support arrangement comprising a front portion, a rear portion and a pair of side portions connecting opposite ends of the front portion and the rear portion, wherein a dispensing opening is arranged in a portion between the front, rear and side portions, the dispensing opening of the support arrangement being defined by a surrounding edge formed by the front, rear and side portions, the edge comprising a leading edge portion and a rear edge portion, wherein the leading edge portion forms an upper guiding edge for the sheets of web material during dispensing thereof, wherein the front portion of the support arrangement comprises a front abutment surface for supporting the stack of sheets of web material, the front abutment surface extending upwardly in a direction from the dispensing opening towards the front side of the dispenser, wherein the dispenser further comprises a lower guiding edge for the sheets of web material during dispensing thereof, the lower guiding edge being arranged at a location downwards from the upper guiding edge towards the front side of the dispenser, the lower guiding edge being below the support arrangement, the front abutment surface, the leading edge portion, and the rear edge portion, wherein an HD plane extends in the height direction and the depth direction through the dispenser and the front side, the abutment surface, the lower guiding edge, the leading edge portion, the dispensing opening, the rear edge portion, and the rear side, wherein:

a first straight line extends in the HD plane through a lowermost part of the abutment surface and an uppermost part of the abutment surface, wherein the first straight line forms an angle a to a first horizontal line extending in the HD plane from a rear wall of the storage compartment, which angle $\alpha$ is from 30 degrees to 60 degrees, a third straight line extends in said HD plane from a lowermost part of the upper guiding edge that defines a limitation for pulling a sheet of web material in contact with the upper guiding edge to a lowermost part of the lower guiding edge that defines a limitation for pulling a straightened sheet of web material in contact with the lower guiding edge and the upper guiding edge, wherein the third straight line forms an angle $\beta$ to the first horizontal line, and a sum of the angles $\alpha$ and $\beta$ is from 45 degrees to 120 degrees.

2. The dispenser according to claim 1, wherein the angle $\alpha$ is from 40 degrees to 50 degrees.

3. The dispenser according to claim 1, wherein the sum of the angles $\alpha$ and $\beta$ is from 60 degrees to 120 degrees.

4. The dispenser according to claim 1, wherein the angle $\beta$ is from 5 to 80 degrees.

5. The dispenser according to claim 1, wherein the front abutment surface has a main plane that extends upwardly in a direction from the dispensing opening towards the front side of the dispenser along the first straight line between the lowermost part and the uppermost part of the front abutment surface, wherein the main plane of the front abutment surface forms the angle a to the first horizontal line.

6. The dispenser according to claim 1, wherein the dispensing opening is arranged in a portion that extends upwardly in an inclined direction from the rear side towards the front side of the dispenser, wherein a fourth straight line extends in said HD plane from a lowermost part of the rear edge portion to the lowermost part of the upper guiding edge that defines the limitation for pulling a sheet of web material in contact with the upper guiding edge, wherein the fourth straight line forms an angle $\varphi$ to the first horizontal line that is from 25 degrees to 60 degree.

7. The dispenser according to claim 1, wherein a rim forms part of the upper guiding edge and extends in a downward direction at the dispensing opening, thereby forming a downwardly facing flange of the upper guiding edge that presents a guiding surface portion for the sheets of web material during dispensing thereof.

8. The dispenser according to claim 1, wherein the upper guiding edge is formed by two or more components.

9. The dispenser according to claim 1, wherein the upper guiding edge has a thickness dimension in the HD plane of at least 2.5 mm between the lowermost part of the upper guiding edge and an upper surface portion of upper guiding edge in the HD plane, which upper surface portion is arranged opposite to said lowermost part in the height direction in the HD plane.

10. The dispenser according to claim 9, wherein the thickness dimension is at least 4 mm.

11. The dispenser according to claim 9, wherein the thickness dimension is 30 mm or less.

12. The dispenser according to claim 1, wherein the upper guiding edge has an edge surface forming an upper guiding surface for the sheets of web material during dispensing thereof, wherein the upper guiding surface presents one or more rounded surface portions in the HD plane.

13. The dispenser according to claim 12, wherein a portion of the upper guiding surface facing upwardly in inclined direction towards the rear side is a rounded surface portion.

14. The dispenser according to claim 12, wherein a portion of the upper guiding surface facing downwardly in an inclined direction towards the rear side is a rounded surface portion.

15. The dispenser according to claim 13, wherein the radius of the rounded surface portion is about 0.5 mm to 2 mm.

16. The dispenser according to claim 1, wherein the housing comprises a rear wall, and a front wall or front door.

17. The dispenser according to claim 16, wherein the lower guiding edge is formed by an edge of the lower end portion of the front wall or front door.

* * * * *